US007970521B2

(12) United States Patent
Sorensen et al.

(10) Patent No.: US 7,970,521 B2
(45) Date of Patent: Jun. 28, 2011

(54) COMBINED FEEDBACK AND COMMAND SHAPING CONTROLLER FOR MULTISTATE CONTROL WITH APPLICATION TO IMPROVING POSITIONING AND REDUCING CABLE SWAY IN CRANES

(75) Inventors: Khalid Lief Sorensen, Austell, GA (US); William Singhose, Atlanta, GA (US); Stephen Dickerson, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 610 days.

(21) Appl. No.: 11/911,747

(22) PCT Filed: Apr. 19, 2006

(86) PCT No.: PCT/US2006/014600
§ 371 (c)(1), (2), (4) Date: May 9, 2008

(87) PCT Pub. No.: WO2006/115912
PCT Pub. Date: Nov. 2, 2006

(65) Prior Publication Data
US 2008/0281464 A1 Nov. 13, 2008

(51) Int. Cl.
*B66C 19/00* (2006.01)

(52) U.S. Cl. ..... 701/50; 340/685

(58) Field of Classification Search ..... 701/50; 700/213, 45; 212/270, 272–275, 319, 225; 294/81.3, 81.4; 340/685
See application file for complete search history.

(56) References Cited

U.S. PATENT DOCUMENTS

| | | | |
|---|---|---|---|
| 4,756,432 | A | 7/1988 | Kawashima et al. |
| 4,916,635 | A | 4/1990 | Singer et al. |
| 4,997,095 | A | 3/1991 | Jones et al. |
| 5,127,533 | A | 7/1992 | Virkkunen |
| 5,526,946 | A | 6/1996 | Overton |

(Continued)

OTHER PUBLICATIONS

Fang et al., "Nonlinear Coupling Control Laws for a 3-DOF Overhead Crane System," 40th IEEE Conference of Decision and Control, Orlando, Florida, USA, 2001.

(Continued)

*Primary Examiner* — Dalena Tran
(74) *Attorney, Agent, or Firm* — Thomas, Kayden, Horstemeyer & Risley, LLP

(57) ABSTRACT

Disclosed are algorithms for controlling multiple states of a dynamic system, such as controlling positioning and cable sway in cranes. Exemplary apparatus and methods may be implemented using first and second serially coupled feedback loops coupled to a plant and payload that are to be controlled. The first feedback loop comprises a first control module. It generates a filtered actuator command from an error signal derived from a signal representing a desired system state and a feedback signal indicative of the actual system state. The generated signal is operative to position the payload. The second feedback loop comprises a second control module that generates a second actuator command that is operative to cause the plant to have an output of zero, to eliminate disturbance-induced oscillations. Input shaping may be employed in the first loop for eliminating motion-induced oscillations. The first control module is used for precise payload positioning, and the second control module is used to reject disturbance-induced oscillations. A model reference loop may be employed that outputs a modeled response that is an estimate of the response of the plant in the absence of external disturbances, and which may be used to generate a second actuator command for causing the plant to follow the modeled response.

17 Claims, 7 Drawing Sheets

U.S. PATENT DOCUMENTS

| | | | | |
|---|---|---|---|---|
| 5,529,193 | A | 6/1996 | Hytonen | |
| 5,638,267 | A | 6/1997 | Singhose et al. | |
| 5,785,191 | A | 7/1998 | Feddema et al. | |
| 5,897,006 | A * | 4/1999 | Habisohn | 212/270 |
| 5,908,122 | A | 6/1999 | Robinett et al. | |
| 5,909,817 | A | 6/1999 | Wallace, Jr. et al. | |
| 5,938,052 | A | 8/1999 | Miyano et al. | |
| 5,960,969 | A | 10/1999 | Habisohn | |
| 5,961,563 | A | 10/1999 | Overton | |
| 6,050,429 | A | 4/2000 | Habisohn | |
| 6,102,221 | A | 8/2000 | Habisohn | |
| 6,866,285 | B1 * | 3/2005 | Stamp, Shawn | 280/491.5 |
| 7,150,366 | B1 * | 12/2006 | Zakula et al. | 212/272 |

OTHER PUBLICATIONS

Kim et al., "A New Vision-Sensorless Anti-Sway Control System for Container Cranes," 38th IAS Annual Meeting, Industry Applications Conference, 2003.

Moustafa "Reference Trajectory Tracking of Overhead Cranes," Journal of Dynamic Systems, Measurement, and Control, vol. 123, pp. 139-141, 2001.

Fliess et al., "A Simplified Approach of Crane Control Via a Generalized State-Space Model," 30th Conference on Decision and Control, Brighton, England, 1991.

Gustafsson et al., "Automatic Control of Unmanned Cranes at the Pasir Panjang Terminal," 2002 IEEE International Conference on Control Applications, Glasgow, Scotland, U.K.

* cited by examiner

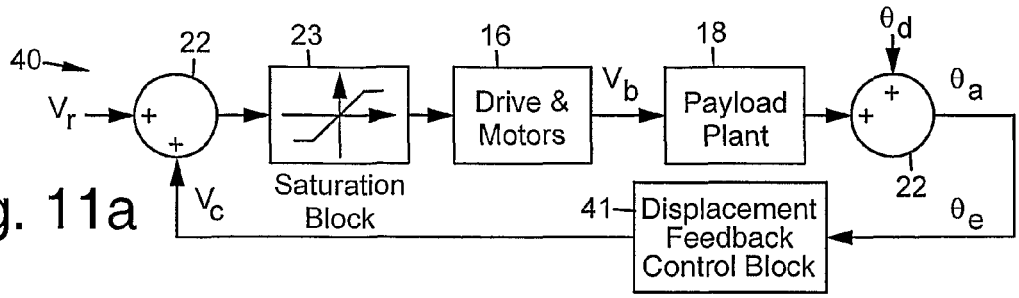
Fig. 11a
Fig. 12
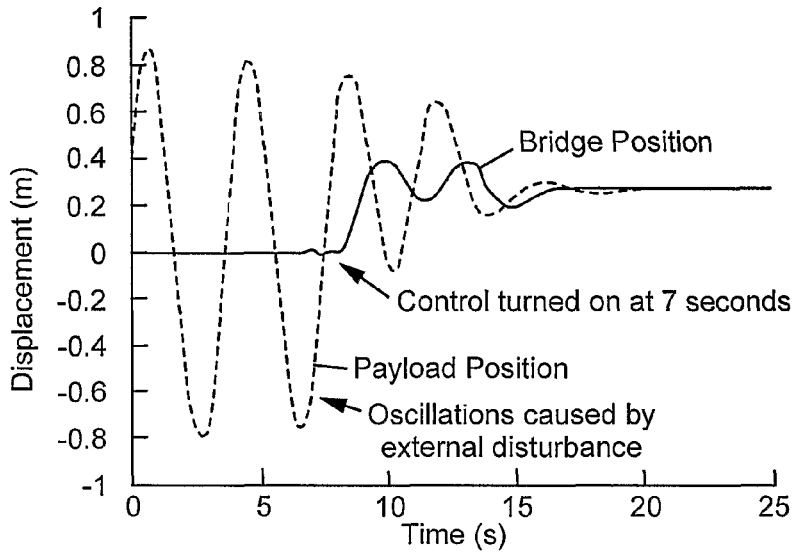
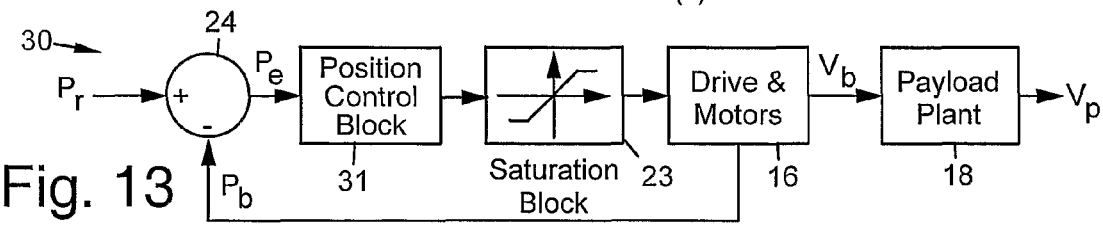
Fig. 13
Fig. 14
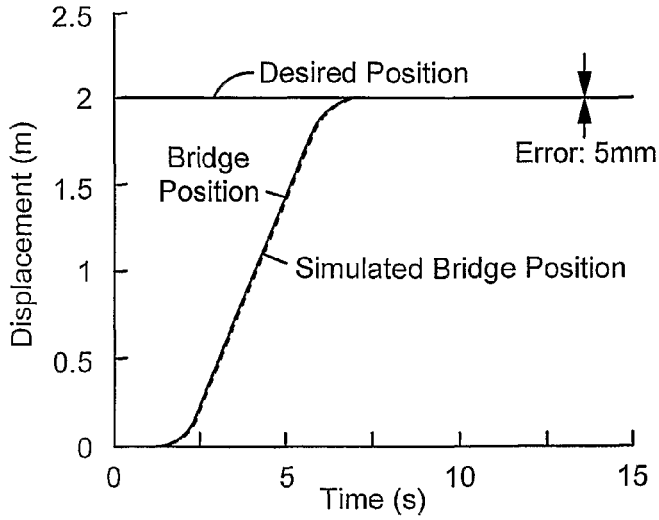

COMBINED FEEDBACK AND COMMAND SHAPING CONTROLLER FOR MULTISTATE CONTROL WITH APPLICATION TO IMPROVING POSITIONING AND REDUCING CABLE SWAY IN CRANES

BACKGROUND

The present invention relates generally to controlling states of dynamic systems. A particularly well-suited application of this technology is the dynamic control of cranes. Specifically, the present invention can be used to improve positioning capability of cranes and reduce undesirable oscillation of the payload.

Cranes occupy a crucial role within industry. They are used throughout the world in thousands of shipping yards, construction sites, steel mills, warehouses, nuclear power and waste storage facilities, and other industrial complexes. The significant role that these systems maintain in the world can hardly be overestimated.

Cranes are highly flexible in nature, generally responding in an oscillatory manner to external disturbances and motion of the overhead support unit (e.g., the bridge or trolley). In many applications this oscillation has adverse consequences. Swinging of the payload or hook makes precision positioning time consuming and inefficient for an operator. When the payload or surrounding obstacles are of a hazardous or fragile nature, the oscillations may present a safety hazard as well.

The broad use of cranes, coupled with the need to control unwanted oscillations has impelled a large amount of research pertaining to the control of these structures. Broadly, engineers have sought to control three aspects of crane systems, namely, motion-induced oscillations, disturbance-induced oscillations, and positioning capability. These aspects of crane systems are important because the ease-of-use, efficiency, and safety of crane systems can be significantly improved if controlled successfully.

A variety of techniques have been developed for controlling the dynamic response of cranes. Fang et al., in "Nonlinear Coupling Control Laws for a 3-DOF Overhead Crane System," presented at 40th IEEE Conference of Decision and Control, Orlando, Fla., USA, 2001, proposed to control final trolley position and cable sway through a proportional-derivative type control, in which the coupling between the cable angle and the motion of the trolley is artificially increased. Kim et al., in "A New Vision-Sensorless Anti-Sway Control System for Container Cranes," presented at 38th IAS Annual Meeting, Industry Applications Conference, 2003, implemented a pole-placement strategy on a real container crane to control cable sway, as well as final positioning. Moustafa in "Reference Trajectory Tracking of Overhead Cranes," *Journal of Dynamic Systems, Measurement, and Control*, vol. 123, pp. 139-141, 2001, used nonlinear control laws for payload trajectory tracking based on a Lyapunov stability analysis. Finally, Fliess et al., in "A Simplified Approach of Crane Control Via a Generalized State-Space Model," presented at 30th Conference on Decision and Control, Brighton, England, 1991, proposed a linearizing feedback control law for a generalized state variable model.

These feedback control schemes are well suited to precisely position the overhead support unit of a crane. However, a difficulty associated with feedback is related to multi-state control. When a feedback controller must minimize cable sway, in addition to positioning a bridge or trolley, the control task becomes much more problematic. Accurate sensing of the payload must be implemented, which is often costly or difficult. When sensing of the payload is available, the control does not respond unless cable sway is present. In this way, the control is inherently reactive instead of anticipatory.

Time-optimal control is a common open-loop approach for obtaining swing free motion. One of the drawbacks to many time-optimal control schemes is their inability to be implemented in real-time owing to the necessity of precomputation of system trajectories. As was indicated by Gustafsson et al., in "Automatic Control of Unmanned Cranes at the Pasir Panjang Terminal," presented at 2002 IEEE International Conference on Control Applications, Glasgow, Scotland, U.K., 2002, there is no known implementation of a time-optimal control scheme used with a commercial crane.

Several patents relating to crane control have been issued. These include U.S. Pat. No. 4,756,432, issued Jul. 12, 1988 to Kawashima, et al., U.S. Pat. No. 5,526,946, issued Jun. 18, 1996 to Overton, U.S. Pat. No. 6,050,429 issued Apr. 18, 2000 to Habisohn, U.S. Pat. No. 5,908,122, issued Jun. 1, 1999 to Robinett, et al., U.S. Pat. No. 4,997,095, issued Mar. 6, 1991 to Jones, et al., U.S. Pat. No. 5,529,193 issued Jun. 25, 1996 to Hytonen, U.S. Pat. No. 5,127,533 issued Jul. 7, 1992 to Virkkunen, U.S. Pat. No. 6,102,221, issued Aug. 15, 2000 to Hibisohn, U.S. Pat. No. 5,938,052, issued Aug. 17, 1999 to Miyano, et al., U.S. Pat. No. 5,785,191, issued Jul. 28, 1998 to Feddema, et al., U.S. Pat. No. 5,960,969, issued Oct. 5, 1999 to Habisohn, U.S. Pat. No. 5,961,563, issued Oct. 5, 1999 to Overton, and U.S. Pat. No. 5,909,817, issued Jun. 8, 1999 to Wallace, Jr., et al.

The present invention addresses the drawbacks and limitations of many of the aforementioned control schemes. Specifically, simultaneous real-time positioning, motion-induced oscillation suppression, and disturbance rejection of cranes is achieved in an easily implementable and computationally simple control scheme.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIGS. 11 and 11*a* are block diagrams that illustrate exemplary disturbance rejection control modules;

FIG. 12 is a graph that illustrates the motion of a crane and payload eliminating disturbance-induced oscillations;

FIG. 13 is a block diagram that illustrates an exemplary position control module;

FIG. 14 is a graph that illustrates actual and simulated bridge response to a reference command of 2 meters;

DETAILED DESCRIPTION

Figure 1:
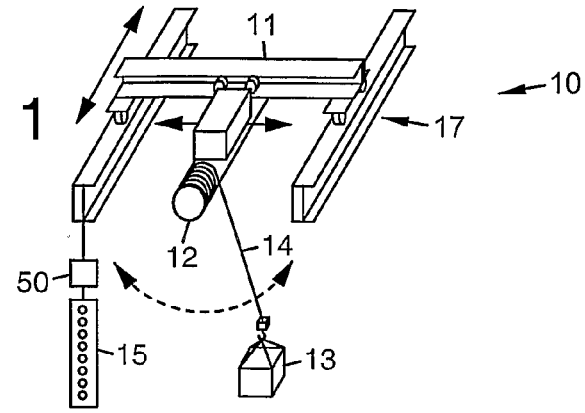
FIG. 1 illustrates an exemplary crane that may employ controllers and control methods disclosed herein.

Referring to the drawing figures, FIG. 1 illustrates an exemplary crane 10 that may employ a control architecture 50 that may be implemented using controllers and control methods disclosed herein. The exemplary crane 10 comprises an overhead support unit 17 comprising an overhead moveable bridge 11 to which a moveable trolley 12 is attached. The moveable trolley 12 is attached by way of a cable 14 to a payload 13.

In typical crane installations without advanced control, the moveable bridge 11 and moveable trolley 12 are ordinarily controlled with a control pendant 15, or other similar device. In the case of a control pendent, an operator commands crane motions by depressing pendent buttons. The signals generated by the pendent are issued to the crane system to actuate crane motion.

In crane installations where the advanced control disclosed herein is implemented, signals generated by a pendent (or similar device) are intercepted and modified by the advanced control. Modified commands are then issued to the crane system to actuate crane motion.

Figure 18:
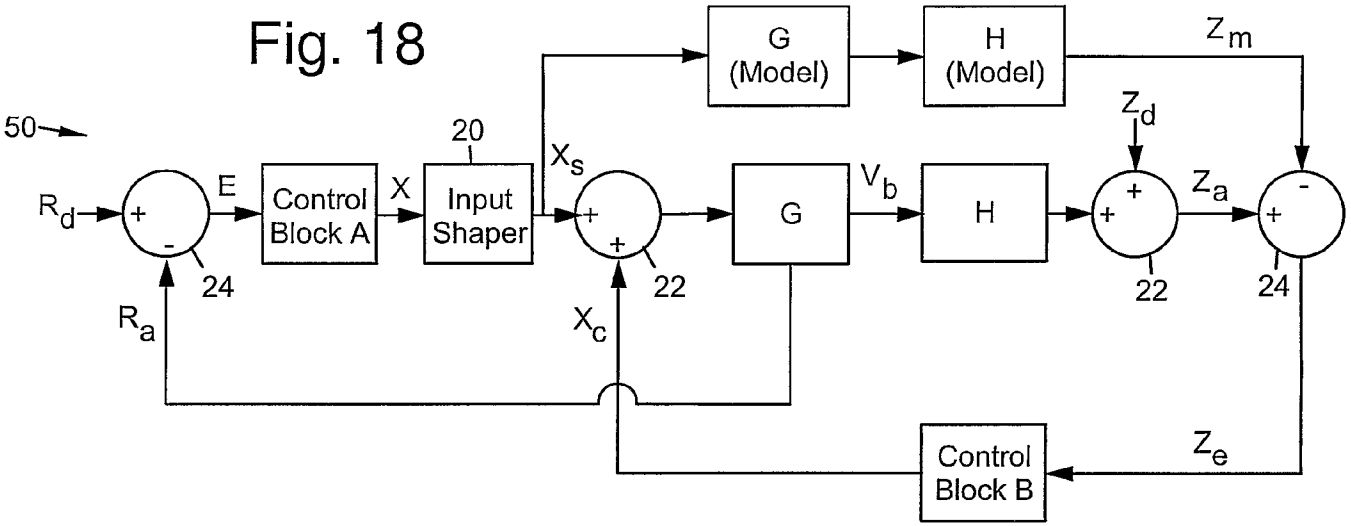
FIGS. 18 and 18*a* illustrate exemplary generalized combined input shaping, disturbance rejection, and positioning controllers.
Figure 18A:
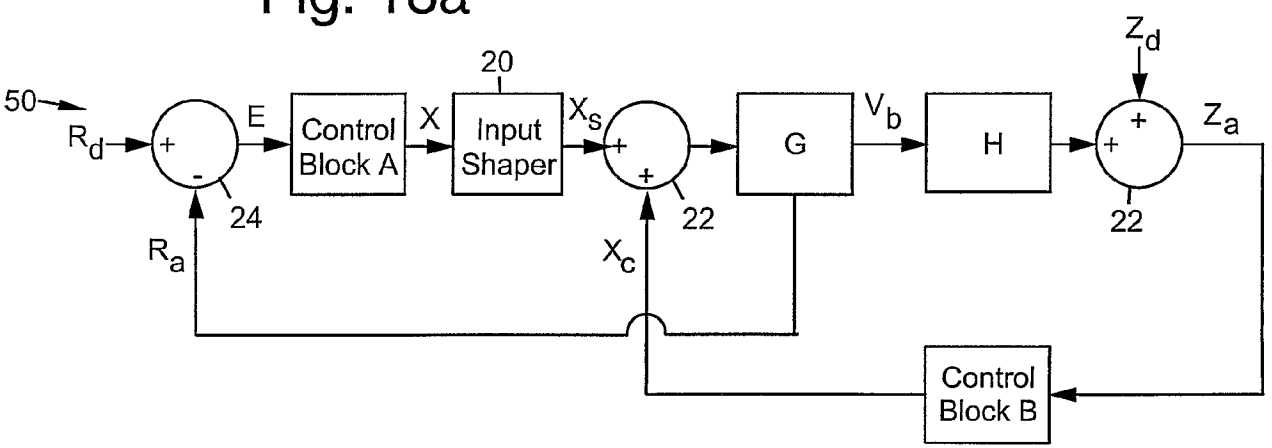

The control architecture embodied in the controllers 50 (FIGS. 15, 15*a*) provides simultaneous, real-time positioning, motion-induced oscillation suppression, and disturbance rejection in cranes 10. Generic forms of these controllers 50 are shown in FIGS. 18, 18*a*.

The exemplary embodiments of the control architecture 50 controls three areas of crane performance, 1) motion-induced oscillations of the payload 13, 2) precise positioning of the payload 13, and 3) disturbance-induced oscillations of the payload 13. The strategy used to accomplish this is to use multiple (three) separate control modules 20, 30, 40 that target each aspect of crane performance. By combining the three distinct modules 20, 30, 40 into a unified control architecture illustrated in FIG. 18 or FIG. 18*a*, the unified architecture has the combined propertied of each of the distinct modules, 20, 30, 40. Thus, the unified control scheme enables the crane to move without sway, reject external disturbances, and precisely position the payload 13. The three control modules 20, 30, 40 are comprised of 1) an input shaping control module 20 to prevent motion-induced oscillations, 2) a position feedback control module 30 that senses the position of the overhead support unit 17 to provide precise positioning of the payload, and 3) a disturbance rejection feedback control module 40 that senses the displacement of the payload to prevent disturbance-induced oscillations.

To better understand this control scheme and architecture, a description of the architecture of the input shaping control module 20 is presented. A methodology is also disclosed that enables one to design or select an input shaper 20, aptly suited for use with nonlinear drives and motors. This methodology is followed by a description of the positioning and disturbance rejection control modules 30, 40. Any number of feedback control mechanisms may be used in the positioning and disturbance rejection modules 30, 40; however, two feedback schemes that serve these purposes are discussed. A description of how the three modules 20, 30, 40 may be combined into a single, unified control scheme is discussed. Variations are presented of how a human crane operator can use the controller 50 in different operational circumstances.

Controlling Motion Induced Oscillation of a Payload

Figure 2:
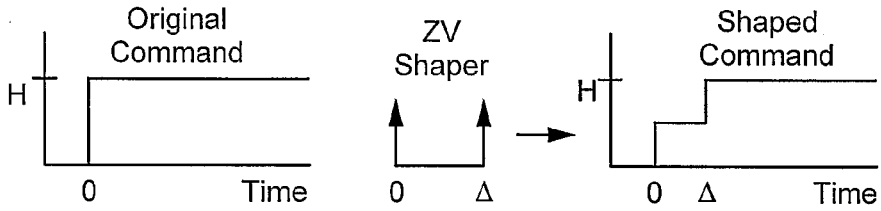
FIG. 2 illustrates an exemplary input shaping process.

Input shaping is a well-documented means for reducing vibration. This is discussed, for example, by N. C. Singer, et al., in "Shaping Command Inputs to Minimize Unwanted Dynamics," MIT, Ed.: U.S. Pat. No. 4,916,635, 1990, and W. Singhose, et al., "Methods and Apparatus for Minimizing Unwanted Dynamics in a Physical System," Vol. Jun. 10, 1997 (U.S. Pat. No. 5,638,267). FIG. 2 shows how input shaping can be implemented on a crane 10. A command, ordinarily generated by an operator's pendent button-push, is convolved with a series of impulses. The output of this operation is issued to the crane system to actuate crane motion. If the amplitudes and times of the impulses are chosen correctly, then the crane's payload 13 will exhibit very little residual oscillation. A block diagram of this open-loop strategy is shown in FIG. 3, which specifically illustrates an exemplary input shaping control module 20.

Figure 3:
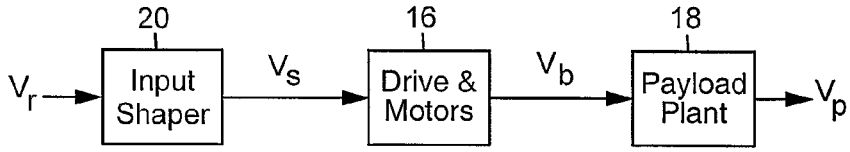
FIG. 3 is a block diagram that illustrates an exemplary input shaping control module.
Figure 4:
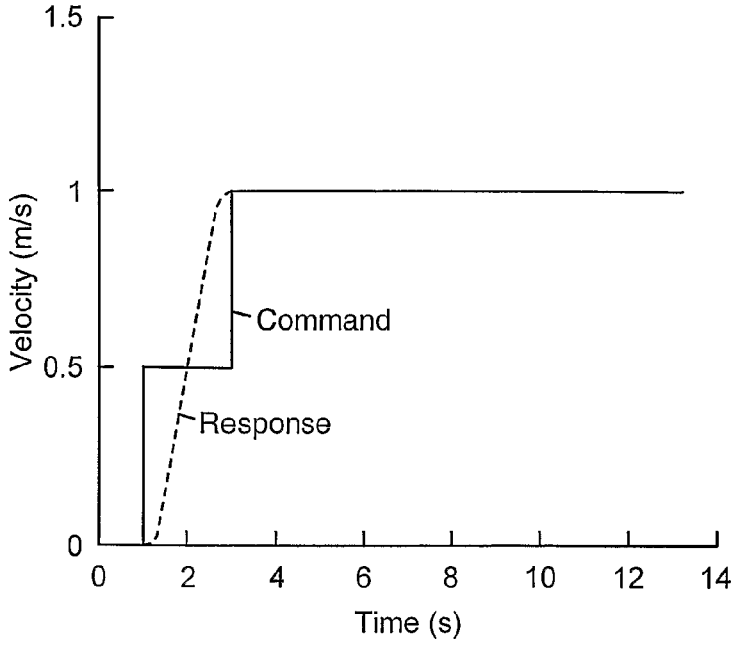
FIG. 4 is a graph that illustrates non-oscillatory response of a crane's payload to shaped motion of its overhead support unit.

FIG. 4 shows the simulated response of a crane's payload 13 resulting from motion of the trolley 12 that has been generated with the input shaping algorithm illustrated in FIG. 3. FIG. 4 shows zero residual vibration payload swing when the input shaping algorithm is used.

Input Shaping on Nonlinear Systems

An important consideration when designing input shaping controllers 20 is the influence that drives and motors 16 have on the effectiveness of shaped signals to eliminate oscillations. If a system's drive and motors 16 can be represented as a linear transfer function, then there is no detrimental effect on the oscillation suppression of an input shaper 20; this is due to the commutability of the input shaper 20 and any linear plant. However, the dynamic attributes of industrial motors and drives 16 can only be approximated by linear transfer functions. It is often the case that nonlinear models of motors and drives 16 can more closely represent the actual response of these components.

Figure 5:
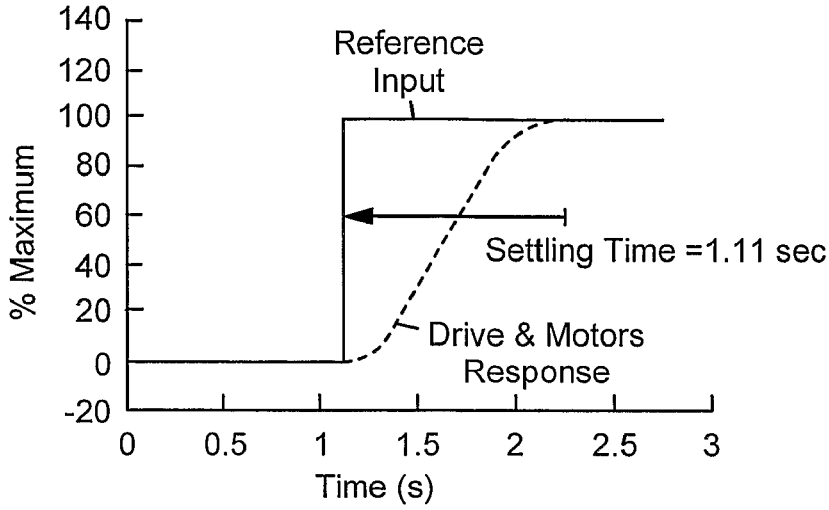
FIGS. 5 and 6 are graphs that illustrate experimental drive and motor responses to step inputs.
Figure 6:
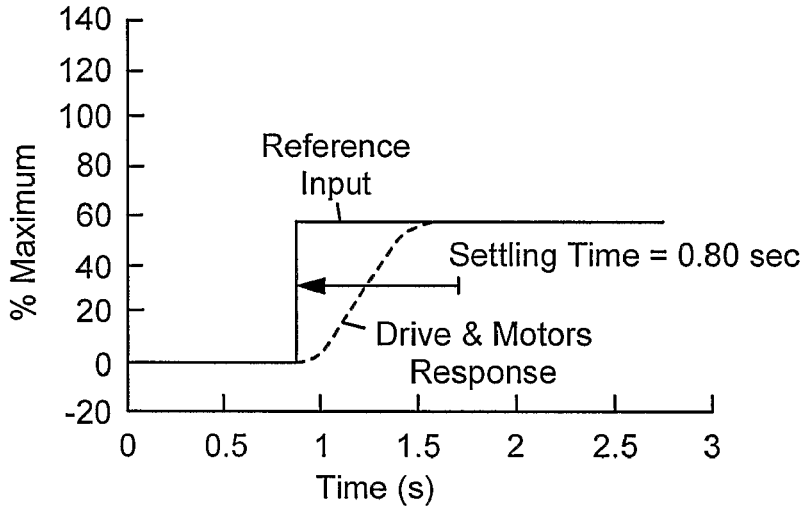

One of the most common nonlinear attributes of industrial drives and motors 16 is a slew rate limit. The slew rate limiting effect prevents the response of drives and motors 16 from exceeding rate-limiting thresholds. To illustrate how this nonlinear attribute of real systems can be modeled, consider the plots in FIGS. 5 and 6. These curves represent the response of an industrial drive-motors system 16 used to actuate the bridge 11 of a 10-ton bridge crane. In FIG. 5, the drive-motors system 16 responds to a step command from 0% actuator effort to 100% actuator effort. In FIG. 6, the drive-motors system responds to a step from 0% actuator effort to 50% actuator effort.

These response curves exhibit zero slopes at the beginning and end of the transient regions; in addition, the responses minimally overshoot each reference signal. These characteristics suggest that the drive and motors 16 have a response similar to a second-order heavily damped system. However, the discrepancy in the settling times between FIGS. 5 and 6 suggest that the drive-motors system 16 is slew rate limited.

Figure 7:
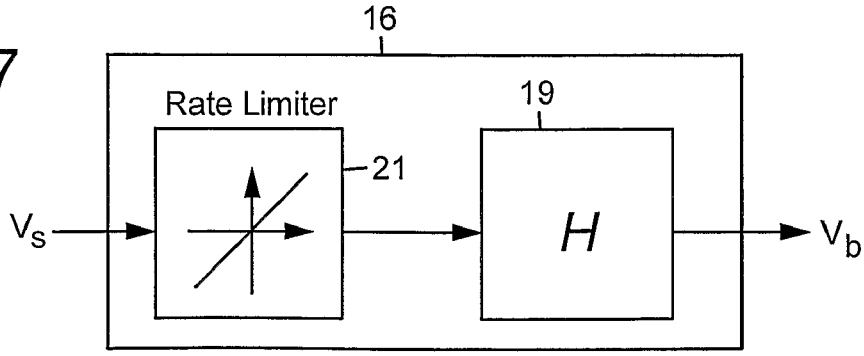
FIG. 7 is a block diagram that illustrates a nonlinear model of an industrial drive-motor system.

To develop a model of the drives and motors 16, a simple two-component system model may be constructed that provides simulated data similar to measured system data. This model is shown in FIG. 7.

A slew rate limiter 21 in the model limits the slew rate of the signal entering it. H is a second-order heavily damped plant 19. An optimization routine can provide a damping ratio and damped natural frequency for the second-order plant 19, and the slew rate parameter for the rate limiter 21. This nonlinear model provides a closer approximation to the actual response of the drive-motors system 16 then a linear model alone.

Figure 8:
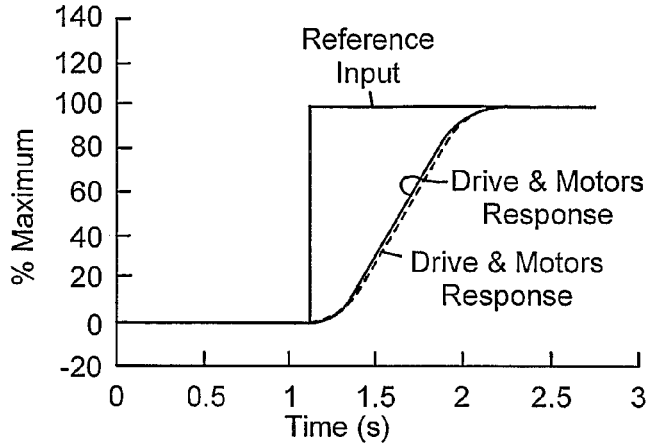
FIGS. 8 and 9 are graphs that show a comparison of actual and simulated drives and motor responses to step inputs.
Figure 9:
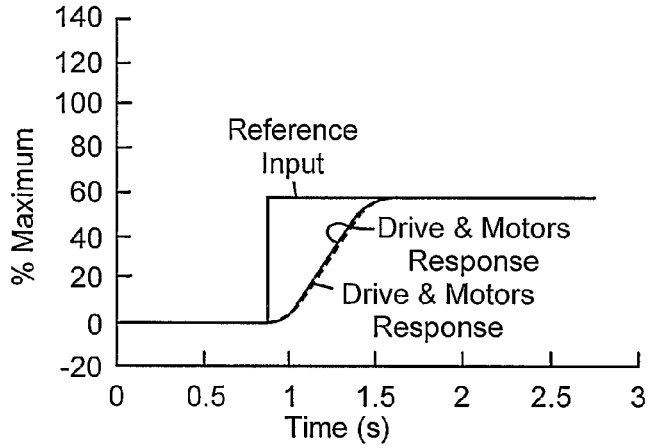

FIGS. 8 and 9 show the responses of the nonlinear model overlaid with the responses of an actual system to step inputs of 50% and 100% actuator effort.

The effects of slew rate limiters 21 in drive-motors systems 16 can be detrimental to oscillation reducing properties of an input shaper 20. In these instances, the presence of the rate limiter 21 reduces the effectiveness of the oscillation absorbing signals produced by the input shaper 20. It is possible, however, to select or design the input shaper 20 where the beneficial oscillation reducing capabilities are unaltered by rate limiters 21. To select/develop an input shaper 20 suitable for use on a system with a rate-limiting element, the following procedure was developed.

1. Determine the slew rate limit parameter of the system. The slew rate limiter 21 may be characterized by a parameter, S, that represents the upper and lower rate thresholds at which the rate limiting element responds to incoming signals. It quantifies how quickly an incoming signal can be modified by the rate limiter 21. S has dimensions of percent per second.

2. Formulate the vibration constraint equations. The selected/designed input shaper 20 must satisfy constraint equations related to the damping ratio and natural frequency of the system. These constraint equations have been documented in U.S. Pat. Nos. 4,916,635 and 5,638,267, for example.

3. Formulate an "R-value" constraint equation. R is non-dimensional ratio that relates how rapidly a reference signal may be altered by the rate limiter 21 to how rapidly an input shaper 20 alters a reference signal. R is related to S and the desired input shaper 20 by the equation:

$$R = \frac{S}{100\% \cdot \max\left(\frac{A_i}{t_i - t_{i-1}}\right)} \geq 1,\ i = 2, 3, \ldots, n$$

where $A_i$ and $t_i$ represent the impulse magnitudes and time locations of the desired input shaper 20.

4. Solve the constraint equations. The solution to the vibration equations and R-value equation will produce an input shaper 20 that will eliminate motion-induced oscillations with signals whose oscillation reducing properties are unaffected by the rate limiter 21.

Controlling Disturbance-Induced Oscillation

Figure 10:
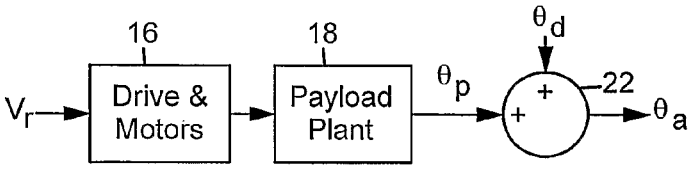
FIG. 10 is a block diagram that illustrates external disturbance affecting the output angle of a payload.

If oscillations of the payload 13 can be sensed, then a disturbance control module 40 (FIG. 11) may be designed to eliminate cable sway caused by external disturbances, such as wind. This type of disturbance alters the cable angle, $\theta_p$, of the payload plant 18. For this reason, the disturbance may be modeled as inducing a disruptive angle, $\theta_d$, that is summed 22 with an undisturbed angle, $\theta_p$, to produce the actual cable angle of the system, $\theta_a$. A disturbance of this sort is schematically illustrated in FIG. 10.

Figure 11:
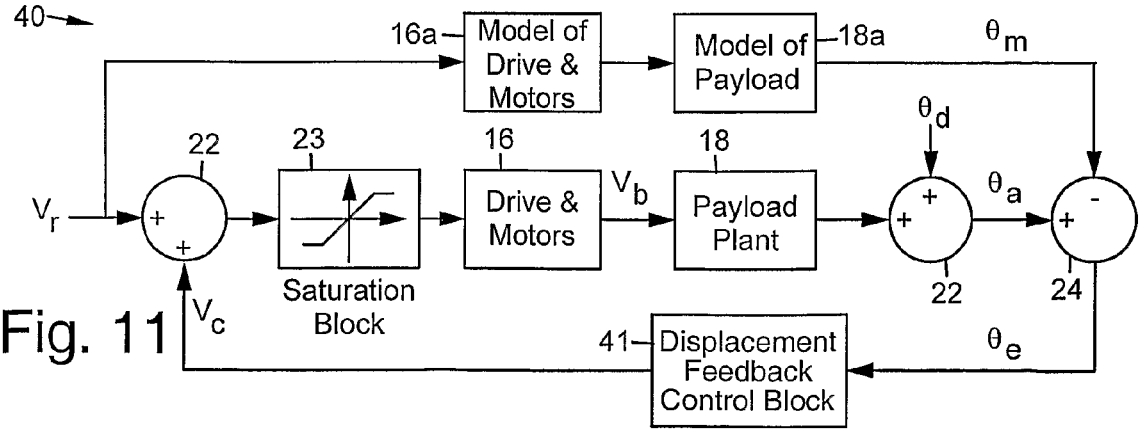

The displacement controller 40 described herein makes use of sensory feedback to detect the actual cable angle, $\theta_a$. This information is utilized in a displacement feedback control block 41 to generate velocity commands that, when sent to the motors 16, cause the crane 10 to eliminate the disruptive oscillations. A block diagram of an exemplary control architecture for controlling cable sway in the direction of bridge travel is shown in FIG. 11. A similar control architecture may be used for orthogonal oscillations in the direction of the trolley travel. A corrective velocity signal, $V_c$, is added to the original reference velocity signal, $V_r$. To prevent overdriving the crane 10 beyond a safe velocity, a saturation block 23 can truncate excessive reference velocities prior to being sent to the bridge drives and motors 16. An alternative control architecture is shown in FIG. 11*a*. This variation lacks the plant models 18*a*, 16*a* of the drive and motors 16 and payload plant 18.

As is shown in FIG. 11, a reference velocity signal, $V_r$, is input into a summing device 22 that is used to subtract a feedback signal derived from the displacement feedback control block 41 from the reference velocity signal, $V_r$. The output of the summing device 22 is input to an optional saturation block 23, which limits the signal's magnitude, and whose output is applied to the drive-motors 16. The drive-motors 16 respond to this command by moving the overhead support unit at velocity $V_b$. In response to the motion of the overhead support unit and external disturbances, the payload plant 18 responds with a cable angle of $\theta_a$.

In the configuration shown in FIG. 11, the reference velocity signal, $V_r$, is input to a model 16*a* of the drive-motors 16 whose output is applied to a model 18*a* of the payload plant. The output of the payload plant 18 is applied to a subtracting device 24. The motion of the payload plant 18 is input to the same subtracting device 24, and the output of the models 16*a*, 18*a* is subtracted therefrom to produce an error signal ($\theta_e$) indicative of the undesired motion of the payload plant 18. The error signal is input to the disturbance rejection control block 41, which produces a corrective velocity signal, $V_c$, that is summed with the reference velocity signal, $V_r$, in the summing device 22.

An aspect of this disturbance rejection control architecture is optional plant models 18*a*, 16*a* that respond to velocity reference signals, $V_r$. The purpose of the models 18*a*, 16*a* is to provide a means by which payload oscillations caused by external disturbances may be distinguished from payload oscillations caused by motion of the overhead support unit 17 (i.e., bridge 11 and trolley 12). That is, in the absence of any disruptive angle, $\theta_d$, the response of the models 18*a*, 16*a*, $\theta_m$, and the response of the actual system, $\theta_a$, to any reference velocity, $V_r$, will be nearly equal, thereby causing no corrective velocity signal to be generated. If, however, a disturbance is present, then the comparison between $\theta_m$, and $\theta_a$, will allow the disturbance rejection control block 41 to generate a correcting signal. Any corrective velocity signal generated is added to the reference velocity, and subsequently sent to the actual drives and motors 16. In this manner the controller 40 seeks to eliminate only disturbance-induced oscillations and not motion-induced oscillations.

Both variations of the disturbance rejection controller 40, 40*a* were implemented and tested on a 10-ton bridge crane 10 located in the Manufacturing Research Center (MARC) at the Georgia Institute of Technology. FIG. 12 shows typical measured results using the controller 40 to eliminate an external disturbance on the crane 10.

Controlling the Final Position of the Payload

Following a well-known procedure outlined by C.-T. Chen in *Linear System Theory and Design,* 3rd ed. New York: Oxford University Press, 1999, it may be readily shown that, given a crane system with payload cable angle, $\theta_a$, the state, $\theta_a$, is stable in the sense of Lyapunov. Therefore, in the absence of an external disturbance and input, the state, $\theta_a$, will always approach zero. By this formal treatment of the system's state equations, an obvious fact is emphasized; the payload 13 will always come to rest directly beneath the suspension point of the cable 14. Therefore, precise positioning of the overhead suspension unit is equivalent to precise positioning of the payload 13. This fact enables the development of a positioning control module 30 to proceed using collocated suspension-unit-position based control rather then a non-collocated payload-position based control.

The control module 30 discussed here is designed to position the payload 13 in the direction of bridge travel. A similar controller 30 may be designed to position the payload in the orthogonal direction of travel of the trolley 12.

In the case of non-Cartesian based cranes, such as tower and boom cranes, the control could be applied to each relevant coordinate such as radial and rotational motion.

Control is accomplished through the use of a position control block 31 that utilizes sensory information about the bridge position. A block diagram of the control module 30 is shown in FIG. 13. A desired bridge position is sent to the control module 30 as a position reference signal, $P_r$. Sensory feedback provides the bridge position, $P_b$. These two signals are compared in a subtracting device 24 to generate an error signal, $P_e$, which is sent to the position control block 31. In response to the error signal, the position control block 31 generates a signal representing a desired bridge velocity that, when sent to the crane motors 16, will drive the crane 10 toward the desired position. To prevent this signal from overdriving the bridge 11 beyond a maximum desired velocity, a saturation block 23 can be inserted after the position control block 31. The reference velocity, $V_r$, truncated by the saturation block 23, is sent to bridge drives and motors 16, where the bridge responds with a velocity, $V_b$. Finally, the payload plant 18 responds to the bridge velocity in an open-loop manner with velocity, $V_p$.

FIG. 14 shows measured results of the control driving the 10-ton bridge crane 10 in the MARC. The bridge 11, initially at the 0-meter position, is commanded to go to a 2-meter position. As shown in FIG. 14, the bridge 11 is able to achieve the desired position with approximately 5 millimeters of precision.

Combining the Three Controllers

Figure 15:
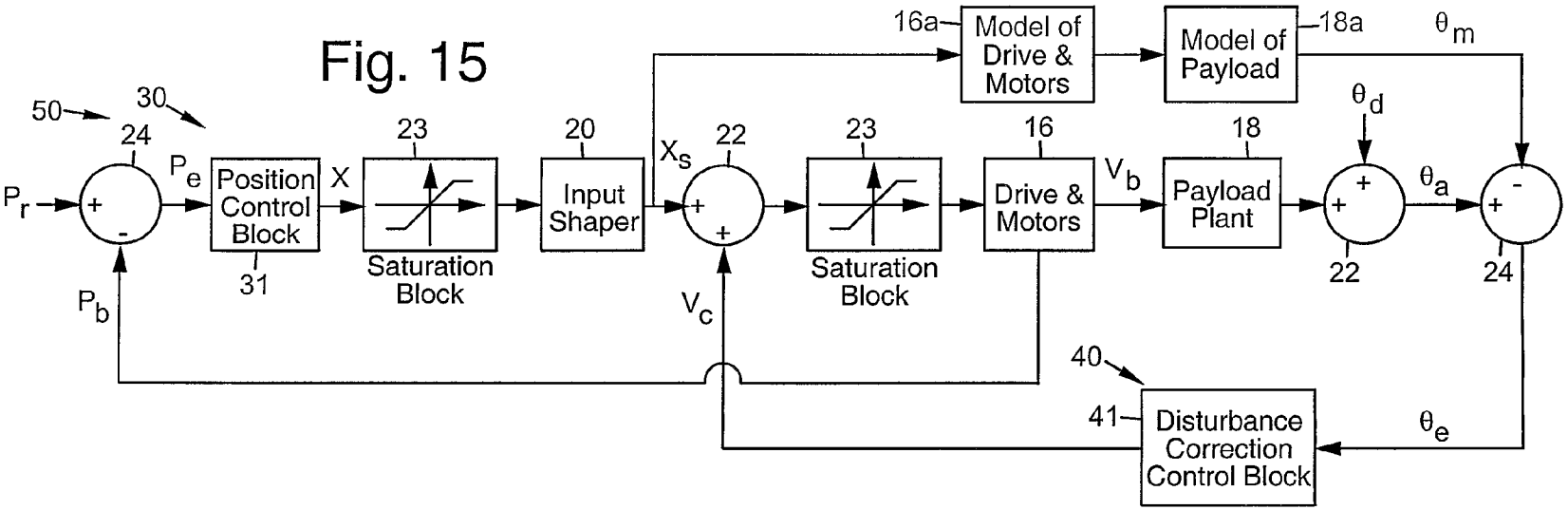
FIGS. 15 and 15*a* illustrate exemplary combined input shaping, disturbance rejection, and positioning controllers.
Figure 15A:
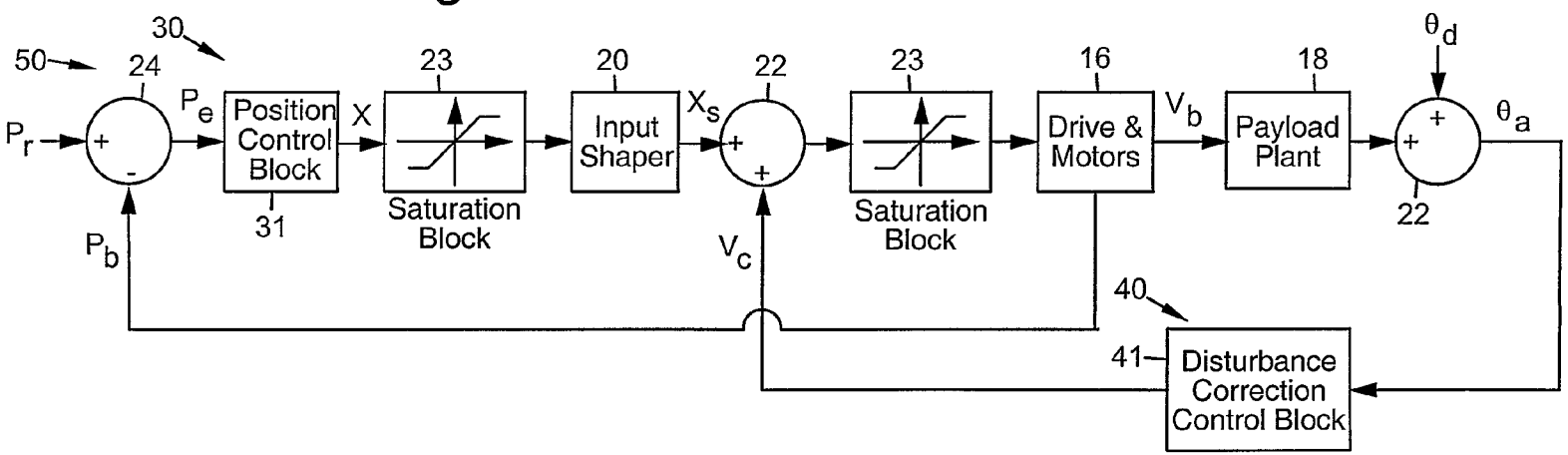

The input shaping, disturbance rejection, and positioning control modules 20, 30, 40 were combined into a single controller 50 that eliminates motion-induced oscillations, disturbance-induced oscillations, and enables precise positioning of the payload 13. A block diagram of the combined control scheme 50 is shown in FIG. 15. A variation of this control scheme 50 is shown in FIG. 15*a*.

In both variations of the control 50, the input shaping module 20 is combined with the positioning module 30. In this way, all the commands generated by the positioning controller 30, which attempt to drive the overhead support point toward a desired position, are modified by the input shaper 20 to prevent motion-induced oscillations. This shaped command is subsequently sent to a model 16*a*, 18*a* of the motors 16 and payload plant 18 to provide a comparison angle, $\theta_m$, by which the disturbance rejection controller 40 may distinguish between motion-induced oscillations and disturbance-induced oscillations. Any corrective velocity signals generated by the disturbance rejection controller 40 are added to the shaped velocity signals of the positioning control module 30. The resulting command accomplishes the dual objectives of final positioning and disturbance rejection.

Figure 16:
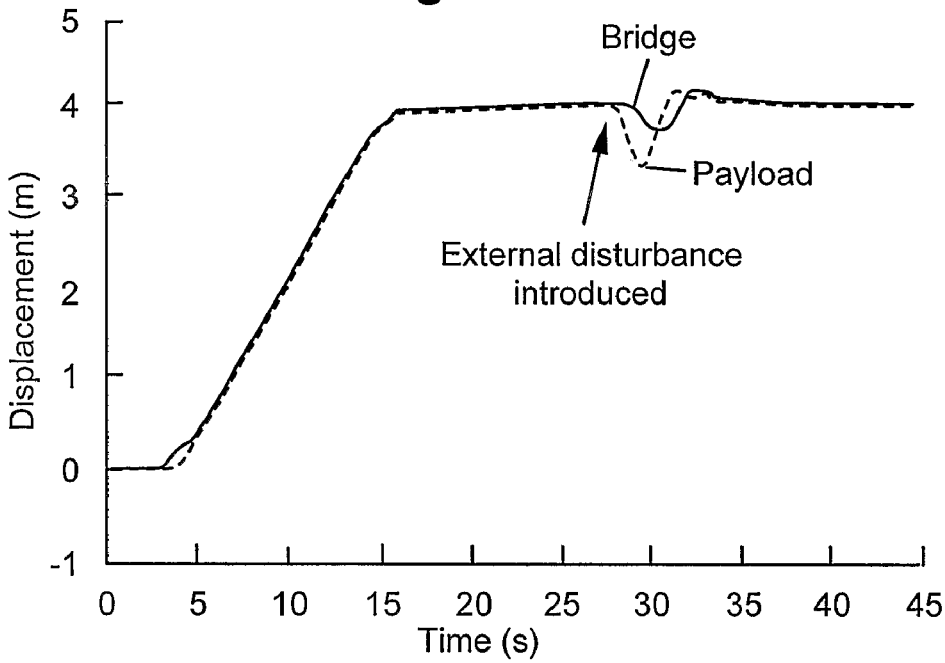
FIGS. 16 and 17 are graphs that illustrate typical bridge and payload responses under the influence of the combined controllers shown in FIGS. 15 and 15*a*.
Figure 17:
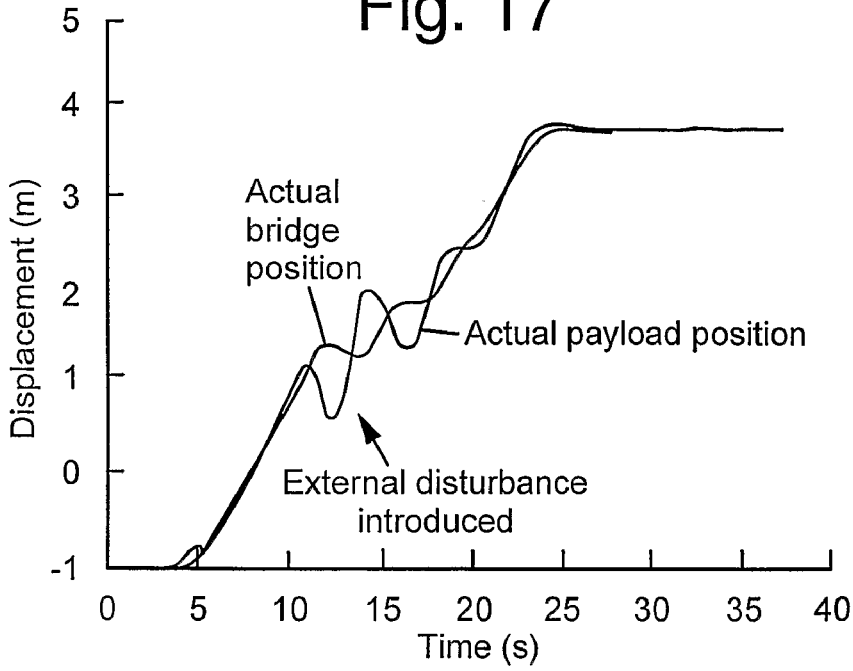

Each variation of the combined control scheme and controller 50 was implemented and tested on the 10-ton bridge crane 10 in the MARC. The performance of the controller 50 is illustrated in measured results shown in FIGS. 16 and 17. The position of the bridge 11 is shown with a solid line, while the position of the payload 13 is shown with a dashed line. The payload 13 and bridge 11, initially at the O-meter location, were commanded to go to the 4-meter location. It is observed that the shaped velocity signals of the combined positioning and input shaping control modules 30, 20 prevented motion-induced oscillations of the payload 13. After an external disturbance was introduced into the system, the disturbance rejection control module 40 eliminated the disruptive oscillations. The positioning control continually drove the payload 13 to the desired position.

Interaction between the Control and the Human Operator

Different crane applications may require different operating modes for the combined controller 50. This section describes manual, partially automatic, and fully automatic modes of operation in which the combined controller 50 may be utilized.

Manual Mode

In cases of infrequent hoisting of irregular objects, where accurate positioning and high efficiency are not essential, a manual mode of operation may be the most appropriate form of control. In manual mode the position reference signals of the controller 50 are generated when the crane operator depresses the directional buttons of the control pendant 15. The crane 10 responds to the operator's button pushes by moving in the direction corresponding to the depressed pendant button; however, because the controller 50 is actively input shaping all the operator's commands, as well as detecting and correcting external disturbances, the motion of the payload 13 will be free from motion and disturbance-induced oscillations.

Partially Automated Mode

The partially automated control mode is essentially manual operation of the crane 10 that is enhanced with an automatic positioning feature. This mode of operation may be appropriate in locations such as the Hanford Site in Washington State where radiological packages are regularly stacked in tight matrix formations, requiring positioning accuracy greater than 3 cm. Because of the hazardous content of the payloads 13, operators often control the cranes 10 remotely, making precise positioning difficult and time consuming.

The partially automated mode allows the motion of the crane 10 to be controlled by the operator's pendent button pushes, just as in manual mode, while the operator attempts to maneuver the crane 10 towards some intended target point. Because of a distant or obstructed view, the operator may have difficulty in driving the crane 10 precisely to the intended destination. Instead, when the crane 10 is in the proximity of the intended target point, sensors on the crane 10, such as a machine vision system or other sensory device, detects coordinate information about the target point. The operator may either continue running the crane 10 in manual mode or use the coordinate information gathered from the sensors as a position reference signal for the control, causing the payload 13 (or hook) to be driven precisely to the intended destination.

In other words, the partially automated mode allows the crane operator to send a position reference signal to the control representing the approximate desired final position of the payload 13 (or hook). While in transit, sensors detect the actual desired position of the hook or payload 13. The control allows the operator to either continue using manually generated reference position signals, or switch to the signal generated by the sensors.

Fully Automated Mode

In fully automated mode, the position set points sent to the controller 50 originate entirely from sensors, a controlling computer, a programmable logic controller, or other programmable or sensing devices. This control mode would be appropriate in highly repetitive tasks or other tasks where the final position of the payload 13 (or hook) is known ahead of time. For example, the controller 50 could drive the crane 10 to a series of positions that correspond to an array of desired positions programmed into a computer. Once the crane 10 has reached a desired position, it would remain stationary for a programmed period of time (perhaps to conduct hoisting operations) at which time the control would proceed to drive the crane 10 to the next desired position.

Thus, from the above, it should be clear that a control scheme and algorithm have been disclosed that may be implemented in the form of a controller 50, 50*a* and control method that allows precise positioning of a crane's payload 13 while also eliminating motion and disturbance-induced oscillations. The controller 50, 50*a* may be operated in manual, semi-automated, and automated modes. Furthermore, the control algorithm can be applied on system that exhibit nonlinear rate limiting effects. The novel features that contribute to these capabilities are summarized below.

Multiple (three) individual control modules 20, 30, 40 are combined in a manner descried above, and shown in FIGS. 18 and 18*a*, to form a unified control architecture. The architectures shown in FIGS. 18 and 18*a*, were successfully implemented to control the dynamic response of a crane 10. The three control modules are, 1) an input shaping module 20 for elimination of motion-induced oscillations, 2) a position feedback control module 30 for precise payload positioning, and 3) a disturbance rejection feedback control module 40 on the crane's payload 13 for disturbance-induced oscillation rejection.

The disturbance rejection controller 40 compares the actual cable angle of the crane 10 with one obtained from a model of the crane 10. The comparison provides a means by which the controller 50 may distinguish between motion-induced oscillations and disturbance-induced oscillations. In this way, the control can generate a correcting velocity signal based on externally induced oscillations.

Generic Controllers

The above description addresses controllers 50 specifically designed for use in controlling operation of an overhead crane 10. However, the controllers 50 may be readily adapted for use in other applications, and the above-described control architecture is not limited solely to crane applications. FIGS. 18 and 18*a* illustrate exemplary generic controllers 50 that may be used to control various types of plants G, H.

The control architectures shown in FIGS. 18 and 18*a* are independent of the application, and may be used on numerous dynamic systems. This control architecture was successfully implemented to control the dynamic response of a crane system, discussed fully above. The three control modules of the control architecture comprise an input shaping module (input shaper 20), and two feedback modules. The controllers 50 employ serially interconnected feedback loops and an optional model reference loop to implement feedback control over a plant (H). The function of the plant models is to estimate the response of the plant (H) in the absence of external disturbances.

The control architecture shown in FIG. 18 compares a modeled plant response, $Z_m$, to an actual plant response, $Z_a$. The comparison provides a means by which control block B may respond to signals caused primarily by external disturbances. If plant models G, Hare not incorporated into the architecture, $Z_a$ is issued directly to control block B, as is illustrated in FIG. 18*a*.

The driving signal used to actuate plant G is a combination of the corrective signal, $X_c$, generated by control block B, and the shaped signal, $X_s$, generated by the input shaper 20. By constructing the driving signal in this way, the three-fold objective (positioning, disturbance rejection, and motion induced oscillation suppression) is accomplished. In particular, motion-induced oscillations of plant H are suppressed; the system follows a reference trajectory, $R_d$; and external disturbances are eliminated.

The function of control block A is to produce an actuator command, X, derived from an error signal, E. The input shaper 20 is operative to filter frequencies from the actuator command, X. In the case where there is no model reference loop present (FIG. 18*a*), the input shaper 20 filters frequencies from the actuator command, X, that correspond to dominant frequencies in the closed-loop transfer function (CLTF) of the secondary feedback loop. In the case where there is a model reference loop present (FIG. 18), the input shaper 20 filters frequencies from actuator command, X, that correspond to dominant frequencies in the plant (H). In the case where there is a model reference loop, the function of control block B is to produce an actuator command, $X_c$, from an error signal, $Z_e$, which causes the plant (H) to follow a modeled response, $Z_m$. In the case where there is no model reference loop, the function of control B 41 is to cause the plant (H) to have an output of zero.

The control scheme is suitable for use in many different operational settings through the use of manual, semi-automated, and automated modes of operation. The unique architecture of the controller 50 allows switching between the different operational modes by changing the origin of the control's reference signal. In manual mode, the reference signal is generated when an operator depresses a pendant button or similar actuation device. In semi-automated mode, the reference signal is generated primarily by an operator, and partially by a PC, PLC, or other automation component. In fully automated mode, the reference signal is generated entirely by a controlling PC, PLC, or other automation component.

In addition, a methodology has been disclosed that enables the design/selection of an input shaper 20 suitable for use with physical systems (cranes 10) that exhibit the nonlinear phenomenon of slew rate limiting. The methodology involves the formulation of an "R-value" constraint equation. A shaper satisfying the traditional vibration constraint equations in addition to the "R-value" constraint equation will be ensured to eliminate oscillations from the nonlinear system.

Control Methods

For the purposes of completeness, exemplary methods for controlling motion of a plant, such as a crane 10 and payload 13, for example, will now be discussed. The various exemplary control methods may be implemented as follows.

An actuator (input) command, $R_d$, representing a desired state of the plant G is issued. An actuator command, X, is generated from an error signal, E, derived from the desired state command, $R_d$, and a feedback signal, $R_a$, from a first feedback loop that is indicative of the actual state of the plant, G. An optional plant model reference may be employed that is used to estimate the response of the plant H in the absence of external disturbances.

Optionally, an input shaper may be employed wherein, if there is no model reference loop, filters frequencies from the actuator command, X, that correspond to dominant frequencies in the closed-loop transfer function (CLTF) of a secondary feedback loop to produce a filtered actuator command, $X_s$. If there is a model reference loop, the input shaper filters frequencies from actuator command, X, to produce a filtered actuator command, $X_s$, that correspond to dominant frequencies in the plant H.

In the case where there is no input shaper and no model reference loop, the actuator command, X, is summed with an actuator command, $X_c$, generated in the secondary feedback loop that is configured to cause the plant, H, to have an output of zero. In the case where there is an input shaper and no model reference loop, the filtered actuator command, $X_s$, is summed with an actuator command, $X_c$, generated in the secondary feedback loop, that is configured to cause the plant to have an output of zero. In the case where there is no input shaper but there is a model reference loop, the actuator command, X, is summed with an actuator command, $X_c$, generated in the secondary feedback loop, that causes the plant H to follow a modeled response, $Z_m$. In the case where there is both an input shaper and a model reference loop, the filtered actuator command, $X_s$, is summed with an actuator command, $X_c$, generated in the secondary feedback loop, that causes the plant H to follow a modeled response, $Z_m$.

Thus, crane controllers and control method have been disclosed. It is to be understood that the above-described embodiments are merely illustrative of some of the many specific embodiments that represent applications of the principles discussed above. Clearly, numerous and other arrangements can be readily devised by those skilled in the art without departing from the scope of the invention.

What is claimed is:

1. Control apparatus comprising:

first and second serially coupled feedback loops coupled to plants G and H that are to be controlled;

wherein the first feedback loop comprises a first control module for generating a filtered actuator command from an error signal that is derived from an input actuator command and a feedback signal that is indicative of the state of the plant G, which filtered actuator command is operative to cause the state of plant G to match a desired state; and wherein the second feedback loop comprises a second control module that generates a second actuator command that is operative to cause the plant H to have an output of zero, so as to prevent disturbance-induced oscillations.

2. The apparatus recited in claim 1 further comprising:

an input shaper disposed in the first feedback loop that filters frequencies from the actuator command corresponding to dominant frequencies in the closed-loop transfer function of the secondary feedback loop, or the plant H, so as to prevent motion-induced oscillations in that plant.

3. The apparatus recited in claim 2 further comprising:

a model reference loop for outputting a modeled response that is an estimate of the response of the plant H in the absence of external disturbances; and apparatus for subtracting the modeled response from the actual plant H response to produce an error signal;

wherein the second feedback loop generates a second actuator command that is operative to cause the plant to follow the modeled response; and wherein the second actuator command is summed with the filtered actuator command to cause the plant to follow a modeled response.

4. The apparatus recited in claim 3 wherein the plant comprises crane drive system that controls movement of the payload which is coupled to the crane drive system by way of a cable.

5. The apparatus recited in claim 4 wherein the second control module compares the angle of the cable with one obtained from the model reference loop to distinguish between motion-induced oscillations and disturbance-induced oscillations and generate a correcting signal based on externally induced oscillations.

6. The apparatus recited in claim 1 further comprising:

a model reference loop for outputting a modeled response that is an estimate of the response of the plant H in the absence of external disturbances; and apparatus for subtracting the modeled response from the actual plant H response to produce an error signal;

wherein the second feedback loop generates a second actuator command that is operative to cause the plant to follow the modeled response; and wherein the second actuator command is summed with the filtered actuator command to cause the plant to follow a modeled response.

7. The apparatus recited in claim 1 wherein the plant comprises crane drive system that controls movement of the payload which is coupled to the crane drive system by way of a cable.

8. The apparatus recited in claim 1 which allows switching between manual, semi-automated, and automated modes of operation by changing the origin of a reference signal input to the apparatus.

9. The apparatus recited in claim 8 wherein in manual mode, the reference signal is generated when an operator depresses an actuation device.

10. The apparatus recited in claim 8 wherein in semi-automated mode, the reference signal is generated primarily by an operator, and partially by an automation component.

11. The apparatus recited in claim 8 wherein in fully automated mode, the reference signal is generated by an automation component.

12. A method for controlling states of a series system comprised of a plant G and H, comprising:

issuing an initial actuator command representing a desired system state;

generating a first actuator command in a first feedback loop from an error signal derived from the initial signal and a feedback signal that is indicative of the current state of the system;

generating a second actuator command in a secondary feedback loop that is responsive to disturbance-induced oscillations of the system and which is configured to cause the plant H to have an output of zero; and combining the first and second actuator commands to produce a combined plant control signal; and applying the combined plant control signal to the plant.

13. The method recited in claim 12 further comprising:

filtering frequencies from the first actuator command that correspond to dominant frequencies in the plant H, or to the dominant frequencies in the closed-loop transfer function of the secondary feedback loop to provide a filtered actuator command.

14. The method recited in claim 13 further comprising:

providing a model reference loop for outputting a modeled response that is an estimate of the response of the system in the absence of external disturbances;

subtracting the modeled response from the actual plant response to produce an error signal;

generating the second actuator command using the error signal as an input so as to cause the plant to follow a modeled response; and combining the second actuator command with the filtered actuator command to cause the plant to follow the modeled response.

15. The method recited in claim 13 wherein filtering is achieved by an input shaper implemented by:

determining a slew rate limit parameter, S, of the plant and payload that represents upper and lower rate thresholds at which a rate limiting therein responds to signals;

defining vibration constraint equations in terms of the damping ratio and natural frequency of the system for which the input shaper is being designed;

defining an R-value constraint equation, where R is non-dimensional ratio that relates how rapidly a reference signal may be altered by the rate limiter to how rapidly the input shaper alters a reference signal; and solving the constraint equations to define the input shaper such that it eliminates motion-induced oscillations with signals whose oscillation reducing properties are unaffected by the rate limiter.

16. The method recited in claim 15 wherein R is related to S and a desired input shaper by the equation:

$$R = \frac{S}{100\% \cdot \max\left(\frac{A_i}{t_i - t_{i-1}}\right)} \geq 1,\ i = 2, 3, \ldots, n$$

where $A_i$ and $t_i$ represent the impulse magnitudes and time locations of the desired input shaper.

17. The method recited in claim 12 further comprising:

providing a model reference loop for outputting a modeled response that is an estimate of the response of the system in the absence of external disturbances;

subtracting the modeled response from the actual plant response to produce an error signal; and generating the second actuator command using the error signal as an input so as to cause the plant H to follow a modeled response.

* * * * *